United States Patent [19]

White

[11] Patent Number: 4,586,196

[45] Date of Patent: May 6, 1986

[54] DISPOSABLE SURGICAL GOWN

[75] Inventor: Roger N. White, Memphis, Tenn.

[73] Assignee: The Kendall Company, Boston, Mass.

[21] Appl. No.: 657,316

[22] Filed: Oct. 3, 1984

[51] Int. Cl.[4] ..... A41B 9/00

[52] U.S. Cl. ..... 2/114; 2/DIG. 7; 2/51

[58] Field of Search ..... 2/114, DIG. 7, 51; 428/198

[56] References Cited

U.S. PATENT DOCUMENTS

| | | | |
|---|---|---|---|
| 3,868,728 | 3/1975 | Krzewinski | 2/114 |
| 4,504,977 | 3/1985 | King et al. | 2/114 |
| 4,504,978 | 3/1985 | Gregory, Jr. et al. | 2/114 |

*Primary Examiner*—Doris L. Troutman

*Attorney, Agent, or Firm*—Donald N. Halgren

[57] ABSTRACT

A disposable surgical gown having areas manufactured from materials having a high degree of air permeability is disclosed. Other portions of the disposable surgical gown are manufactured from material which are liquid repellent or liquid impermeable.

3 Claims, 1 Drawing Figure

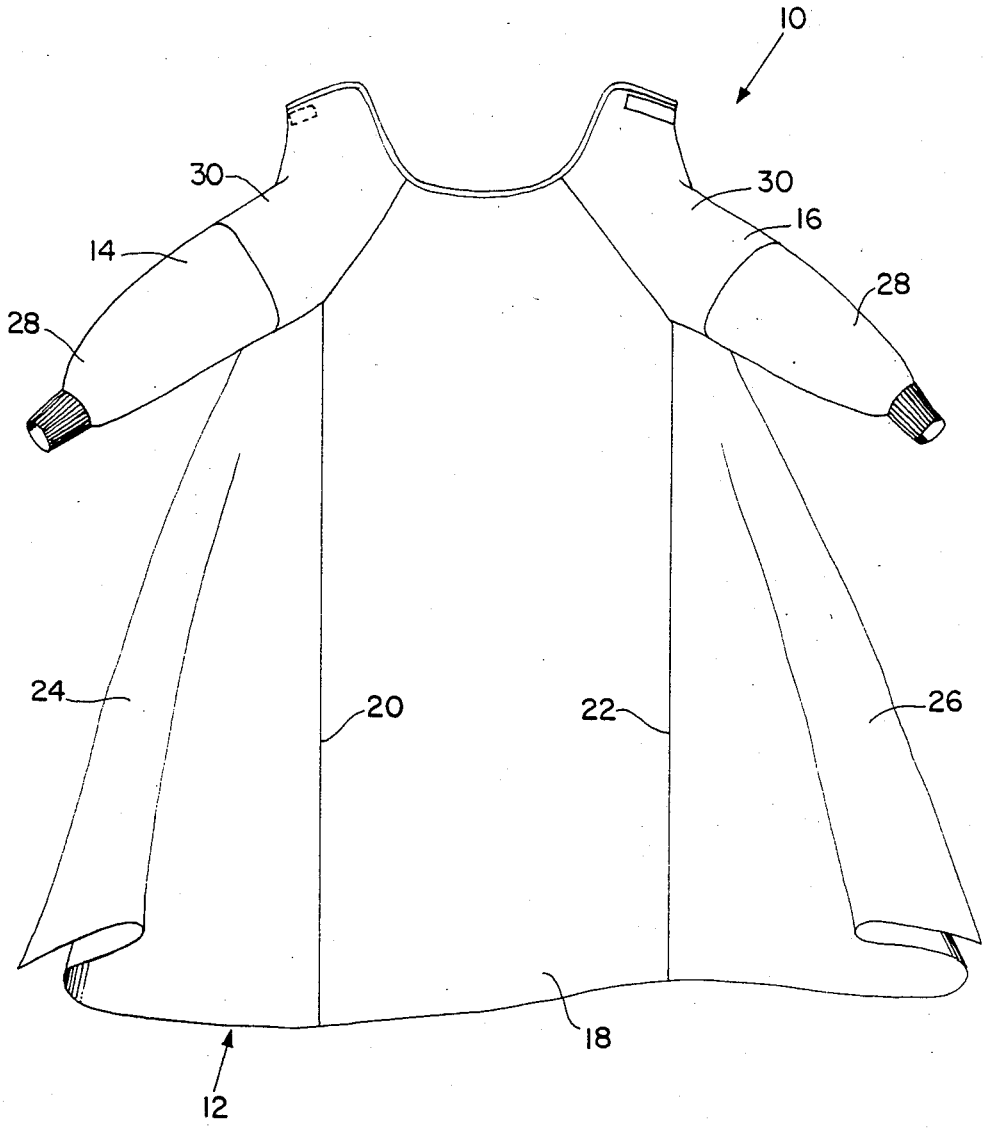
10
30
30
16
14
28
28
24
20
22
26
18
12

DISPOSABLE SURGICAL GOWN

BACKGROUND OF THE INVENTION

This invention relates to disposable surgical gowns and more particularly relates to disposable surgical gowns having improved breathability to enhance the comfort of the wearer.

Surgical gowns are generally worn by members of an operating team during the performance of surgery. These gowns are made to completely cover the surgeon's front and back torso, as well as his arms. The gown is made sterile and is intended to prevent any possibility of infection being transmitted from the surgeon's arms or torso to the patient. To perform adequately, the surgical gown must inhibit liquid transfer, thereby protecting the surgeon and his clothing against soiling by blood, plasma, serums and other liquids.

Materials which are liquid repellent or liquid impermeable and which are suitable for use in manufacturing a disposable surgical gown do not possess a high degree of air permeability. Accordingly, disposable surgical gowns tend to be uncomfortable due to the buildup of body heat which is maintained in close proximity to the wearer.

It is therefore an object of the present invention to provide a disposable surgical gown having improved comfort during wearing.

A further object of the present invention is to provide a disposable surgical gown having portions which permit air to readily pass through their thickness thereby increasing the comfort of the wearer.

SUMMARY OF THE INVENTION

According to the present invention, a disposable surgical gown is manufactured having portions which are highly air permeable. In particular, the upper sleeves and rear torso covering portions are manufactured from materials which readily permit air to pass through. The front torso covering portion and the lower sleeves are manufactured from liquid repellent and, preferably, liquid impermeable material.

BRIEF DESCRIPTION OF THE DRAWING

FIG. 1 is a perspective view of the disposable surgical gown of the present invention.

DESCRIPTION OF A PREFERRED EMBODIMENT

Referring now to FIG. 1 there is shown a back closing disposable surgical gown manufactured in accordance with the present invention. As used herein, the term "disposable" refers to surgical gowns which are intended to be used once (i.e., they are not intended to be laundered or otherwise restored and reused) before being discarded. As used herein the term "surgical gown" refers to an article of clothing intended to be worn by members of an operating room team (e.g. surgeons, nurses, etc.) during the performance of surgery. Surgical gowns, as used herein, include, but are not limited to, gowns generally referred to as surgeon's gowns and scrub gowns.

Surgical gown 10 comprises a torso enveloping portion 12 and sleeves 14 and 16. The torso enveloping portion 12, in a preferred embodiment has a front panel 18 having a first longitudinal side 20 and a second longitudinal side 22. The torso enveloping portion 12 also comprises a first rear panel 24 and a second rear panel

26. First and second rear panels 24 and 26 are affixed to front panel 18 along first and second longitudinal sides 20 and 22, respectively. Any suitable means, as is well known in the art, may be used to affixed first and second rear panels 24 and 26 to first and second longitudinal sides 20 and 22, respectively. For example, first and second rear panels 24 and 26 may be sewn to first and second longitudinal sides 20 and 22.

The torso enveloping portion 12 may be manufactured in a variety of sizes to accommodate different sized wearers. In general, however, the front panel 18 should be of a size sufficient to cover the front portion of the wearer's torso. The first and second rear panels 24 and 26 are preferably of a size sufficient to enable them to cover the back portion of the wearer's torso.

The front panel 18 may be manufactured from a wide variety of materials. The material used for front panel 18 is liquid repellent and preferably is liquid impermeable. In this regard, front panel 18 may be manufactured from a liquid impermeable material or provided with a liquid impermeable backing sheet (not shown) in those portions of front panel 18 which are advantageously rendered liquid impermeable (e.g., the upper chest). A suitable liquid impermeable backing sheet may be manufactured from ethylene methyl acrylate.

The material used for the front panel 18 shown in the preferred embodiment illustrated in FIG. 1 is a laminate of a spunbonded nylon fabric having a basis weight of 0.59 oz./sq. yd. and a tissue sheet having a basis weight of 15 lbs./3000 sq. ft. Preferably, the tissue sheet is manufactured in accordance with the teachings of U.S. Pat. No. 3,301,746 entitled Process for Forming Absorbent Paper by Imprinting a Fabric Knuckle Pattern Thereon Prior to Drying and Paper Thereof, which issued to Sanford et al. on Jan. 31, 1967, which patent is incorporated herein by reference.

Sleeves 14 and 16 are affixed to the torso enveloping portion 12 in any suitable manner as is well known in the art. For example, sleeves 14 and 16 may be sewn to the torso enveloping portion 12. Sleeves 14 and 16 both have a lower portion 28 and an upper portion 30. The lower portion 28 of the sleeves 14 and 16 is manufactured from a liquid repellent and preferably liquid impermeable material. The same spunbonded-tissue laminate previously described as being suitable for use as front panel 18 may be used for lower portion 28. Likewise, a liquid impermeable backing sheet (not shown) may also be used in the lower portion 28.

The upper portion 30 of sleeves 14 and 16 is manufactured from a material which is vapor and air permeable. Preferably, the upper portion 30 of sleeves 14 and 16 is manufactured from a nonwoven material having an air permeability at least about 300 cubic feet/minute/square foot and most preferably at least about 400 cubic feet/minute/square foot.

In the preferred embodiment shown in FIG. 1 the upper portion 30 of sleeves 14 and 16 was manufactured from a spunbonded, continuous filament nylon web having a basis weight of 0.94 oz./sq. yd. an an air permeability of 435 cubic feet/minute/square foot.

In a particularly embodiment, first and second rear panels 24 and 26 are also manufactured from a material which is vapor and air permeable. A suitable material for first and second rear panels 24 and 26 is the same as that used for the upper portion 30 of sleeves 14 and 16.

In use, the wearer inserts their arms into sleeves 14 and 16. The front panel 18 covers the front of the wearer's torso, while first and second rear panels 24 and 26 are drawn aroung the back of the wearer thereby covering the rear of the wearer's torso. The garment is held in place on the wearer by any of the means well known in the art, such as a belt (not shown). During use, the forearms and front torso of the wearer are protected from wetting by the lower portion 28 of sleeves 14 and 16. The comfort of the gown 10 is improved due to the vapor and air permeable upper portion 30 of sleeves 14 and 16 and of the first and second rear panels 24 and 26. As the wearer perspires and gives off body heat, the perspiration is absorbed by and the air within the gown allowed to pass through upper portion 30 and first and second rear panels 24 and 26.

What is claimed is:

1. A disposable surgical gown comprising:

a torso enveloping portion; and sleeves affixed to said torso enveloping portions, said sleeves each having an upper portion and a lower portion, said upper portion being vapor permeable and having an air permeability of at least about 300 cubic feet/minute/square foot, said lower portion being liquid impermeable.

2. The disposable surgical gown of claim 1 wherein said torso enveloping portion comprises a front panel having a first longitudinal side and a second longitudinal side, a first rear panel affixed to said first longitudinal side and a second rear panel affixed to said second longitudinal side.

3. The disposable surgical gown of claim 2 wherein said first rear panel and said second rear panel have an air permeability of at least about 300 cubic feet/-minute/per square foot.

* * * * *